United States Patent [19]

George

[11] 4,347,674

[45] Sep. 7, 1982

[54] ATHLETIC SHOE

[76] Inventor: Gary F. George, 5076 Bishop, Detroit, Mich. 48224

[21] Appl. No.: 138,317

[22] Filed: Apr. 8, 1980

[51] Int. Cl.[3] ..... A43B 5/00; A43C 15/00

[52] U.S. Cl. ..... 36/126; 36/67 R

[58] Field of Search ..... 36/126, 127, 128, 129, 36/134, 59 R, 32 R, 67 R, 67 D

[56] References Cited

U.S. PATENT DOCUMENTS

| | | | |
|---|---|---|---|
| 1,867,219 | 7/1932 | Harper | 36/126 |
| 2,677,905 | 5/1954 | Dye | 36/128 |
| 3,466,763 | 9/1969 | Levin | 36/126 |

*Primary Examiner*—Patrick D. Lawson

*Attorney, Agent, or Firm*—Gifford, VanOphem, Sheridan & Sprinkle

[57] ABSTRACT

An improved athletic shoe is disclosed which is particularly suited for use in the game of baseball. The athletic shoe comprises a sole having an upper secured to it and extending upwardly from its upper side. A first set of cleats extends downwardly from the sole and comprises at least three thin and arcuate cleats. Moreover, this first set of cleats is secured to the ball portion of the sole and positioned in a ring so that each cleat has substantially the same radius and center as each other. A second set of thin and arcuate cleats is also secured to the ball portion of the sole in a ring concentric with the first set of cleats but on a smaller radius than the first set of cleats. The first and second set of cleats provide improved pivoting for the athletic shoe.

6 Claims, 2 Drawing Figures

ATHLETIC SHOE

BACKGROUND OF THE INVENTION

I. Field of the Invention

The present invention relates generally to athletic shoes and, more particularly, to an athletic shoe particularly suited for use in baseball.

II. Description of the Prior Art

Athletic shoes, and particularly baseball shoes, typically comprise a sole having an upper extending upwardly from the sole and into which the foot of the athlete is positioned and secured in place. In addition, a plurality of cleats are secured to the sole and extend downwardly from it which improve the traction of the shoe when the athlete runs.

Although the cleats typically found on baseball shoes vary in precise form, typically three narrow cleats are secured to the bottom of the sole in a spaced apart relationship near the front or ball portion of the sole. Likewise, three or more relatively narrow cleats are secured to the heel portion of the sole in a spaced apart relationship. The cleats on both the ball and heel portion of the sole are straight when viewed from the bottom of the shoe and are usually positioned at oblique angles with respect to each other. One example of such a previously known baseball shoe can be seen in U.S. Pat. No. 3,040,450 which issued on June 26, 1962 to F. C. Phillips. In the well known fashion, these previously known cleats dig into the ground when the athlete runs for improved traction.

The previously known athletic or baseball shoes, however, suffer from a number of disadvantages. One major disadvantage of these previously known baseball shoes is that such shoes hinder or resist pivoting of the athlete on the ball portion of the shoe. This hindrance results primarily from the oblique angles at which the straight cleats are arranged so that, when the athlete pivots on the ball portion of the shoe, the cleats drag along and dig up or plow the ground along a relatively wide area. This in turn causes a great deal of resistance and slows the overall pivoting action of the shoe and likewise the pivotal speed of the athlete.

Because of this resistance encountered by the athlete when pivoting with the previously known baseball shoe, it has been the practice of many athletes to bend the shoe forward prior to pivoting so that only the forwardmost cleat on the baseball shoe contacts the ground and then the athlete pivots in a desired fashion. While this procedure effectively reduces the resistance or drag caused by the cleats digging into the ground when pivoting since only one cleat contacts the ground, the traction of the athletic shoe is inadequate following the pivot since only one cleat contacts the ground. Moreover, the athlete is sometimes left in an awkward position following the pivot which adversely effects the subsequent running acceleration of the athlete.

A still further disadvantage of the previously known baseball shoe is that the cleats are relatively small and narrow so that the free end of each cleat forms a small and sharp cutting edge. Such cleats can cause relatively deep and serious cuts when the baseball player is sliding or the like. Likewise, these previously known small and narrow cleats can dig completely into the ground so that the sole of the baseball shoe rests upon the ground. This, however, is undesirable since the sole of the baseball shoe itself provides little, if any, traction while the baseball player is running.

SUMMARY OF THE PRESENT INVENTION

The present invention provides an improved baseball shoe which overcomes all of the previously mentioned disadvantages of the previously known baseball shoes.

In brief, the baseball shoe, like the previously known baseball shoes includes a sole having an upper secured to it and extending outwardly from the upper side of the sole. The athlete's foot, of course, is received within and secured to the upper in the conventional fashion.

A first set of cleats is also secured to the front or ball portion of the sole so that this first set of cleats extends outward from the bottom side of the sole. This first set of cleats includes at least three cleats which are separate and spaced apart from each other.

Unlike the previously known cleats, however, each cleat is narrow and arcuate in shape and the cleats are arranged in a ring centered at the forward portion of the sole. Thus, each cleat is arcuate in shape and formed on substantially the same radius as the other cleats and each of the cleats has a common center.

In a preferred form of the invention, a second set of at least three cleats is also secured to and extends downwardly from the front portion of the baseball shoe sole. This second set of cleats is also arranged in a ring concentric with the first ring of cleats but on a smaller radius. Each cleat of the second set likewise is arcuately formed on the same radius and also shares the same center as the first set of cleats.

The two concentric rings or sets of cleats on the bottom of the baseball shoe improves the pivotal action of the shoe by reducing the friction or drag of the cleats as the shoe is pivoted on the ball portion of the sole. This reduced drag is accomplished since the first set of cleats all rotate in a common circle while, similarly, the second set of cleats rotates in a separate but also common circle. Moreover, due to the larger number of cleats and the increased surface contact with the ground, the cleats do not dig into the ground as deep as the cleats of the previously known baseball shoes thus minimizing the resistance of the shoe during the pivotal action. Similarly, since each of the cleats is arcuate in shape, during pivoting of the shoe an area only equal in width to the width of the cleat is plowed out or dug into the ground thus further reducing the resistance or drag of the cleat during pivoting.

The dual concentric rings of cleats further has the advantage of shifting the pivot point of the baseball shoe rearwardly from the toe of the shoe. This is advantageous in that at the completion of the pivot, all of the cleats on the front portion of the shoe are in contact with the ground for better traction during the subsequent running acceleration of the baseball player.

A rear set of cleats is also provided on the heel of the sole. This rear set of cleats also preferably comprises three arcuate cleats positioned in a ring so that the cleats are formed on the same radius and also have a common center with each other. Furthermore, the rearward most cleat of this rear set is preferably angled forwardly to effectively force the weight of a running athlete towards the forward portion of the shoe for better traction.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
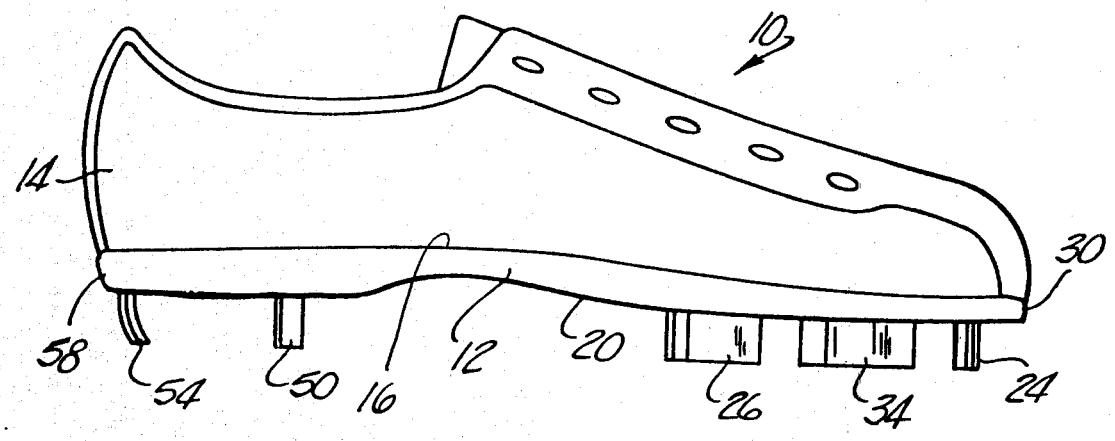
FIG. 1 is a side view of a preferred embodiment of the athletic shoe of the present invention.
Figure 2:
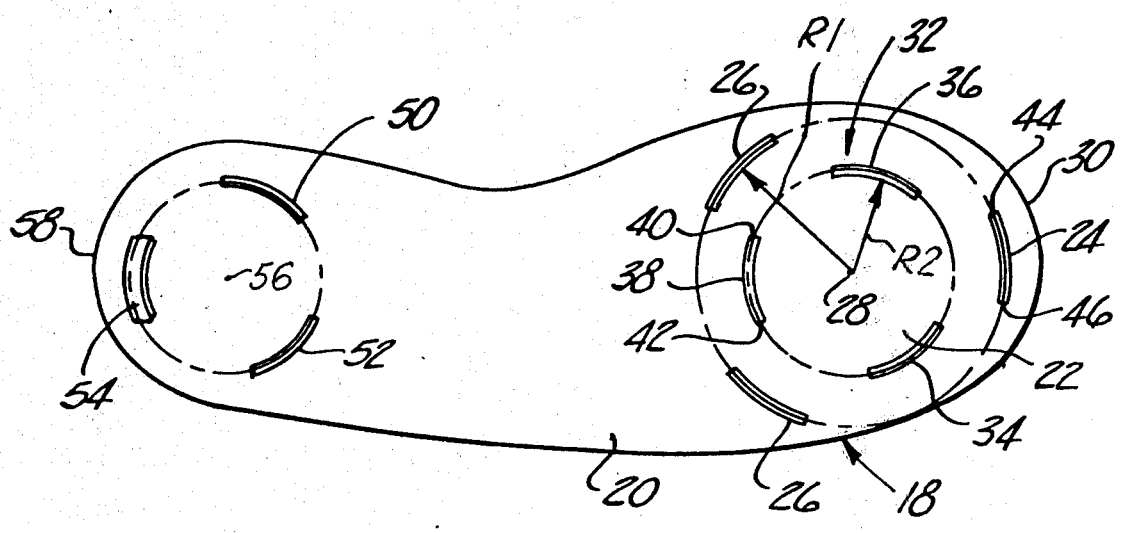
FIG. 2 is a bottom view thereof.

With reference first to FIGS. 1 and 2, a preferred embodiment 10 of the baseball shoe according to the present invention is thereshown and comprises a flat sole 12 having an upper 14 secured to it and extending upwardly from the upper side 16 of the sole 12. The upper 14 is adapted to receive the foot of an athlete therein and is secured to the athlete's foot in the conventional fashion.

A first set of cleats 18 are secured to the sole 12 so that the first set of cleats 18 extend outwardly from the bottom 20 of the sole 12 on the front or ball portion 22 of the sole 12. As is best shown in FIG. 2, the first set 18 of cleats further comprises a front cleat 24 and two rear cleats 26 positioned on opposite lateral sides of the sole 12.

Each cleat 24 and 26 in the first set 18 of cleats is relatively long, narrow and arcuate in shape. Furthermore, the cleats 24 and 26 are arranged in a ring so that each cleat 24 and 26 has the same radius R1 of curvature and each cleat 24 and 26 shares a common center 28. The center 28 is substantially in the center the ball portion 22 of the sole 12. In addition, the front cleat 24 extends substantially laterally across the center line of the sole 12 and adjacent the forwardmost portion 30 of the sole 12.

Still referring to FIG. 2, a second set 32 of cleats is also secured to the ball portion 22 of the sole 12 so that the second set 32 of the cleats extends downwardly from the bottom 20 of the sole 12. The second set 32 of cleats further comprises two front cleats 34 and 36 and a rear cleat 38. Each cleat 34, 36 and 38 in the second 32 is elongated, narrow and arcuate in shape.

The cleats 34, 36 and 38 are arranged in a ring so that each cleat 34, 36 and 38 has the same radius of curvature R2 and share the same center 28 as the first set 18 of cleats. The radius R2 of curvature of the second set 32 of cleats, however, is less than the radius R1 of curvature of the first set of cleats 18 so that the sets 18 and 32 of cleats form two concentric circles centered on the middle of the ball portion 22 of the sole 12 for a reason to be subsequently described.

Still referring to FIG. 2, the rear cleat 38 of the second set 32 extends substantially transversely across the center line of the sole 12 while the front two cleats 34 and 36 are positioned on opposite lateral sides of the sole center line. Moreover, the front two cleats 34 and 36 extends outwardly from a line connecting the ends 40 and 42 of the rear cleat 38 of the second set 32 with the corresponding ends 44 and 46 of the front cleat 24 of the first set 18 for a reason to be subsequently described. The cleats 34, 36 and 38 of the second or inner set 32 also taper slightly outwardly and away from each other to prevent mud or dirt from becoming entrapped between the inner set 32 of cleats.

Although not critical to the present invention, preferably the centerline of the rear cleats 26 of the first or outer set 18 are spaced from the center line of the forward most cleat 24 by substantially 130°. Similarly, the centerline of the front two cleats 34 and 36 of the inner or second set 32 are spaced from the center line of the rear cleat 38 by substantially 130° for a reason to be subsequently described.

Referring now particularly to FIG. 2, three cleats 50, 52 and 54 are secured to the heel portion of the sole 12. These cleats 50, 52 and 54 are also elongated and arcuate in in shape and arranged in a ring having a center 56 to enhance pivoting on the heel if desired. More importantly, however, the rear cleat 54 extends substantially transversely across the centerline of the sole 12 adjacent the rearward most end 58 of the sole 12 is angled towards the front 30 of the sole 12 as best shown in FIG. 1. Thus, when the baseball player is running, this rear cleat 54 securely grips and digs into the ground and throws the weight of the baseball player towards the front or ball portion 22 of the shoe for better traction. The angling of the rear cleat 54 also prevents this cleat 54 from digging into the ground during slides and the like.

All of the cleats for the shoe of the present invention are construction of any rigid material, such as steel or other metal, or a rigid rubber.

In operation, the two concentric rings or sets 18 and 32 of the cleats cause the baseball player, when pivoting, to pivot substantially around the center 28 at the center of the sole ball portion 22 thus effectively moving the pivot point rearwardly along the shoe as compared with the previously known baseball shoes. This is advantageous in that at the completion of the pivot, all six cleats at the front of the shoe are in contact with the ground for improved traction during the initial running acceleration of the baseball player. In addition, upon completion of the pivot, the baseball player is in a less awkward position for good running acceleration than was possible with the previously known baseball shoes.

A still further advantage of the baseball shoe of the present invention is that upon pivoting, the cleats 24 and 26 in the first set 18 all travel in the same groove or circle thus minimizing the resistance or drag of the cleats with the ground. The same is also true for the cleats 34, 36 and 38 of the second set since these cleats also rotate in the same groove or circle. Moreover, since all of the cleats are arcuately formed, the circular groove which is dug out from the ground by the first and second set of cleats corresponds only in width to the width of the cleats thus further minimizing the resistance between the cleats and the ground. This simultaneously reduces the drag of the cleats on the ground and maximizes the pivotal speed of the athlete.

The baseball shoe of the present invention is further advantageous in that the front three cleats on the shoe, i.e., the cleats 24, 36 and 34 provide improved traction for the baseball player during running since these three cleats are laterally adjacent each other and, together, extend laterally across more than half of the front of the sole 12. Since these cleats are laterally adjacent each other, however, the front two cleats 34 and 36 of the inner set 32 channel dirt toward the front cleat 24 of the outer set 18 upon acceleration after the pivot to thereby increase traction. Moreover, since a greater number of cleats are provided on the baseball shoe of the present invention and since these cleats are longer in longitudinal length than the cleats of the previously known baseball shoes, a greater surface area contact between the cleats and the ground is obtained. This ensures not only that the sole 12 of the shoe does not contact the ground but also minimizes the severity of cuts and other gashes which have resulted from cleats of the previously known baseball shoe.

The baseball shoe of the present invention is further advantageous in that the relatively wide front cleat 24 will tend to straighten pigeon toed or duck toed runners for greater running speed.

Although the shoe of the present invention has been described primarily for use as a baseball shoe, it will be understood that the shoe can be adapted for other types of sports.

Having described my invention, however, many modifications thereto will become apparent to those skilled in the art to which it pertains without deviation from the spirit of the invention as defined by the scope of the appended claims.

I claim:

1. An athletic shoe comprising:

a sole, an upper secured to said sole and extending outwardly from an upper side of the sole, a first set of at least three narrow and arcuate cleats secured to the forward portion of said sole and extending outwardly from the lower side of said sole, each of said cleats being positioned on said sole on substantially the same radius of curvature and substantially having a common center and a second set of at least three narrow and arcuate cleats secured to the forward portion of said sole and extending outwardly from said lower side of said sole, said second set of cleats being positioned on said sole concentrically with said first set of cleats but on a radius from said center smaller than said first set of cleats.

2. The invention as defined in claim 1 wherein the cleats in said second set taper away from each other.

3. The invention as defined in claim 1 wherein said first set of cleats is centered on the ball of the sole.

4. The invention as defined in claim 1 wherein a front cleat in said first set is positioned adjacent at the forwardmost portion of the sole and wherein one cleat in said second set extends laterally outwardly from a line extending from one end of said front cleat and longitudinally along said sole and wherein a further cleat in said second set extends laterally outwardly from a further line extending from the other end of said front cleat and longitudinally along said sole.

5. The invention as defined in claim 1 a further comprising a rear set of cleats secured to the rear portion of said sole and extending outwardly from the bottom thereof, said rear set of cleats including one cleat extending transversely across the sole adjacent the rearwardmost portion of the sole.

6. The invention as defined in claim 5 wherein said one cleat in said rear set is angled toward the forward portion of said sole.

* * * * *

REEXAMINATION CERTIFICATE (850th)

United States Patent [19]

George

[11] B1 4,347,674

[45] Certificate Issued May 3, 1988

[54] ATHLETIC SHOE

[76] Inventor: Gary F. George, 5076 Bishop, Detroit, Mich. 48224

Reexamination Request:
No. 90/001,186, Mar. 3, 1987

Reexamination Certificate for:

| | |
|---|---|
| Patent No.: | 4,347,674 |
| Issued: | Sep. 7, 1982 |
| Appl. No.: | 138,317 |
| Filed: | Apr. 8, 1980 |

[51] Int. Cl.[4] ..... A43B 5/00; A43C 15/00
[52] U.S. Cl. ..... 36/126; 36/67 R

[56] References Cited

U.S. PATENT DOCUMENTS

| | | | |
|---|---|---|---|
| D. 171,130 | 12/1953 | Gruner | D2/320 |
| 1,867,219 | 7/1932 | Harper | 36/126 |
| 1,876,195 | 9/1932 | Youmans | 36/134 |
| 2,677,905 | 5/1954 | Dye | 36/128 |
| 3,466,763 | 9/1969 | Levin | 36/126 |
| 4,266,349 | 5/1981 | Schmohl | 36/32 R |
| 4,347,674 | 9/1982 | George | 36/126 |

*Primary Examiner*—Steven N. Meyers

[57] ABSTRACT

An improved athletic shoe is disclosed which is particularly suited for use in the game of baseball. The athletic shoe comprises a sole having an upper secured to it and extending upwardly from its upper side. A first set of cleats extends downwardly from the sole and comprises at least three thin and arcuate cleats. Moreover, this first set of cleats is secured to the ball portion of the sole and positioned in the ring so that each cleat has substantially the same radius and center as each other. A second set of thin and arcuate cleats is also secured to the ball portion of the sole in a ring concentric with the first set of cleats but on a smaller radius than the first set of cleats. The first and second set of cleats provide improved pivoting for the athletic shoe.

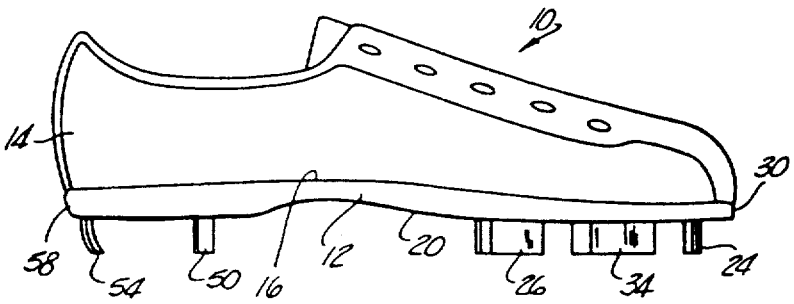

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, after line 63:

*As is shown in FIG. 1, the lower free edges of each cleat is spaced from but substantially parallel to the sole of the shoe.*

AS A RESULT OF REEXAMINATION, IT HAS BEEN DETERMINED THAT:

Claim 1 is determined to be patentable as amended.

Claims 2–6, dependent on an amended claim, are determined to be patentable.

1. An athletic shoe comprising:

a sole, an upper secured to said sole and extending outwardly from an upper side of the sole, a first set of at least three narrow and arcuate cleats secured to the forward portion of said sole and extending outwardly from the lower side of said sole, each of said cleats being positioned on said sole on substantially the same radius of curvature and substantially having a common center and a second set of at least three narrow and arcuate cleats secured to the forward portion of said sole and extending outwardly from said lower side of said sole, said second set of cleats being positioned on said sole concentrically with said first set of cleats but on a radius from said center smaller than said first set of cleats,

*wherein said cleats are dimensioned so that a lower edge of said cleat(s) digs into a ground surface in use,*

*wherein said cleats are constructed of a rigid material,*

*wherein a lower free edge of each cleat is elongated, arcuate and spaced from but substantially parallel to the sole of the shoe.*

* * * * *